US008434882B2

(12) United States Patent
Tian et al.

(10) Patent No.: US 8,434,882 B2
(45) Date of Patent: May 7, 2013

(54) LED LAMP

(75) Inventors: Feng Tian, Shenzhen (CN); Tay-Jian Liu, Taipei Hsien (TW); Yuan Long, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 518 days.

(21) Appl. No.: 12/702,321

(22) Filed: Feb. 9, 2010

(65) Prior Publication Data

US 2011/0084554 A1 Apr. 14, 2011

(30) Foreign Application Priority Data

Oct. 13, 2009 (CN) ..... 2009 1 0308227

(51) Int. Cl.
*F21V 23/06* (2006.01)

(52) U.S. Cl.
USPC ..... 362/20; 362/183; 315/51; 315/57

(58) Field of Classification Search ..... 362/20, 362/183, 218, 221, 222, 223, 225
See application file for complete search history.

(56) References Cited

U.S. PATENT DOCUMENTS

| | | | | |
|---|---|---|---|---|
| 4,563,629 | A * | 1/1986 | Keiper | 320/134 |
| 4,590,543 | A * | 5/1986 | Chen | 362/183 |
| 6,612,717 | B2 * | 9/2003 | Yen | 362/245 |
| 7,490,957 | B2 * | 2/2009 | Leong et al. | 362/249.05 |
| 2005/0002186 | A1 * | 1/2005 | Krieger et al. | 362/183 |

FOREIGN PATENT DOCUMENTS

| | | |
|---|---|---|
| CN | 200956674 | 10/2007 |
| CN | 101070949 | 11/2007 |

* cited by examiner

*Primary Examiner* — Sharon Payne
(74) *Attorney, Agent, or Firm* — Altis Law Group, Inc.

(57) ABSTRACT

An LED lamp includes an optical part, a heat dissipation member and an electric part. The optical part includes a hollow light penetrable tube and an LED module received in the tube. The heat dissipation member is received in the tube to mount the LED module thereon. The electric part include a circuit board and a rechargeable battery arranged in the tube, and two end covers arranged at two opposite ends of the tube. The LED module is provided with at least one first LED and at least one second LED. The at least one first LED and the at least one second LED cooperatively function as a main light source to provide normal illumination when an external AC power source is supplied normally. The at least one second LED independently function as an auxiliary light source to provide emergency illumination when the external AC power source is interrupted.

1 Claim, 6 Drawing Sheets

LED LAMP

BACKGROUND

1. Technical Field

The disclosure generally relates to light emitting diode (LED) lamps, and particularly to an LED lamp which is capable of providing both normal and emergency illuminations.

2. Description of Related Art

To resolve the problem of global warming and natural resource exhaustion, low power consuming electrical devices are required. LED lamps are developed to meet the power-saving trend. LED lamps having LEDs (light emitting diodes) are preferable for use to CCFLs (cold cathode fluorescent lamps) and other traditional lamps due to the excellent properties, including high brightness, low power consumption, long lifespan, environment friendliness, rapid start-up, directivity, etc of the LEDs.

Nowadays, LEDs have been used in both a general lamp for normal illumination and an emergency lamp for emergency illumination. However, the conventional LED-type general lamp is individually designed for normal illumination where an external alternating current (AC) power source is readily available. The conventional LED-type emergency illumination is typically installed in places such as hallways, stairs, passageways, and other areas needing an emergency illumination. The conventional LED-type emergency illumination is constantly inactive, except when the AC power source to the conventional LED-type general lamp is interrupted. To equip a same area with both the general and emergency lamps is costly in money and space.

Therefore, it is desirable to provide an LED lamp which is capable of providing both normal and emergency illuminations.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION

Figure 1:
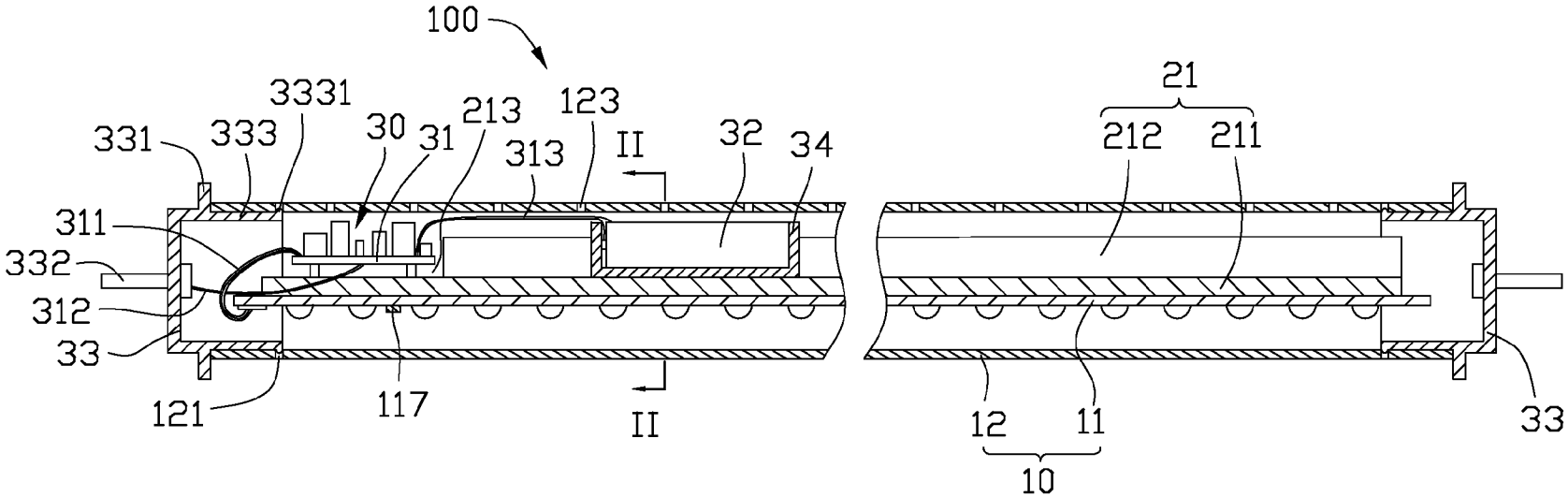
FIG. 1 is a longitudinal cross-sectional view of an LED lamp in accordance with an exemplary embodiment of the present disclosure.
Figure 2:
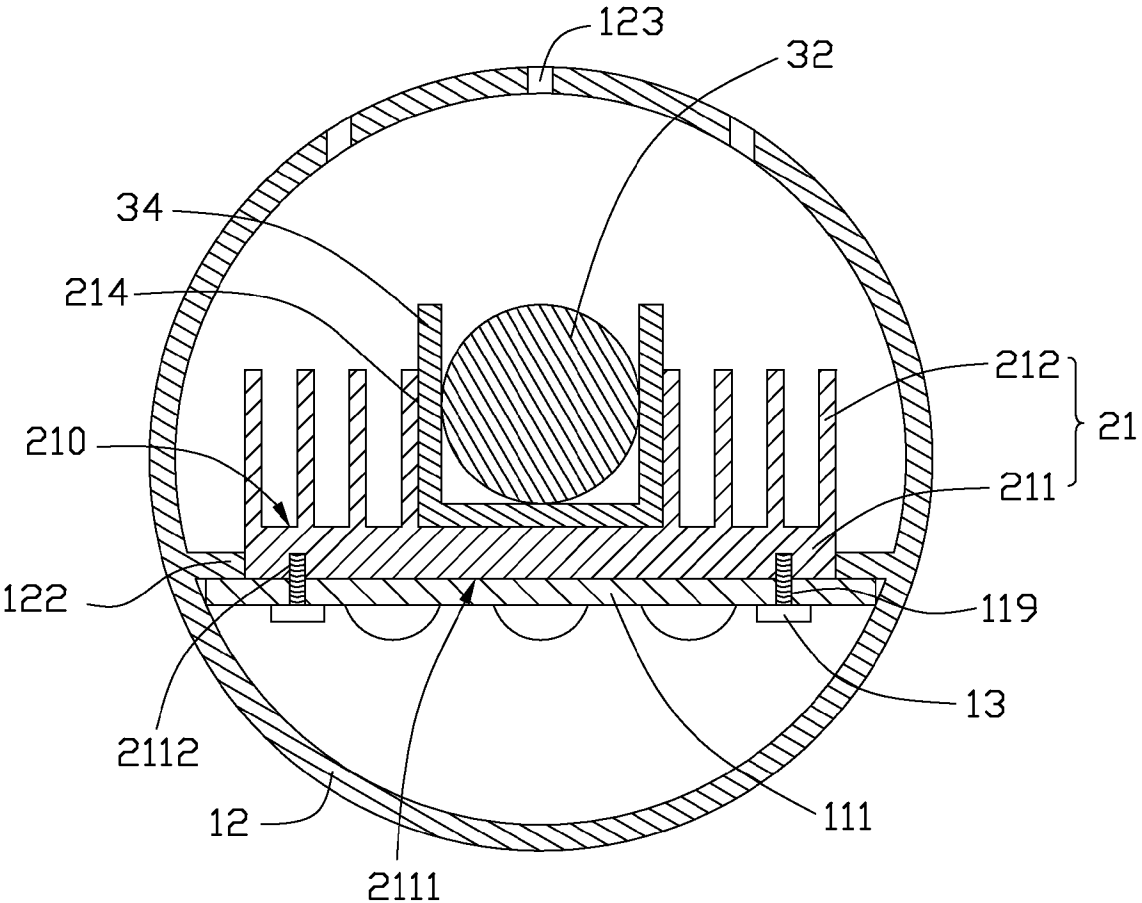
FIG. 2 is a transverse cross-sectional view of the LED lamp of FIG. 1, taken along line II-II thereof.

Referring to FIGS. 1 and 2, an LED lamp 100 according to an exemplary embodiment of the present disclosure includes an elongated heat dissipation member 21, an optical part 10 and an electric part 30. The LED lamp 100 is capable of providing both normal and emergency illuminations.

The heat dissipation member 21 includes an elongated metal base 211 and a plurality of spaced metal fins 212 integrally extending from the base 211. The base 211 is substantially rectangular, and has a top surface 210 and an opposite bottom surface 2111. The fins 212 extend vertically and upwardly from the top surface 210 of the base 211 and have a uniform height.

The heat dissipation member 21 is provided with a receiving space 213 and an accommodating space 214 at a top side thereof. The receiving space 213 is located adjacent to a left end of the heat dissipation member 21, and formed by cutting out the fins 212 of the left end of the heat dissipation member 21. The accommodating space 214 is located at a middle portion of the heat dissipation member 21, and formed by cutting out the fins 212 of the middle portion of the heat dissipation member 21. The base 211 defines a plurality of fixing holes 2112 in the bottom surface 2111 thereof.

The optical part 10 includes an LED module 11 and an elongated light penetrable tube 12. The LED module 11 is thermally attached to the bottom surface 2111 of the base 211 of the heat dissipation member 21. The bottom surface 2111 of the base 211 functions as a heat-absorbing surface for absorbing heat generated by the LED module 11.

Figure 3:
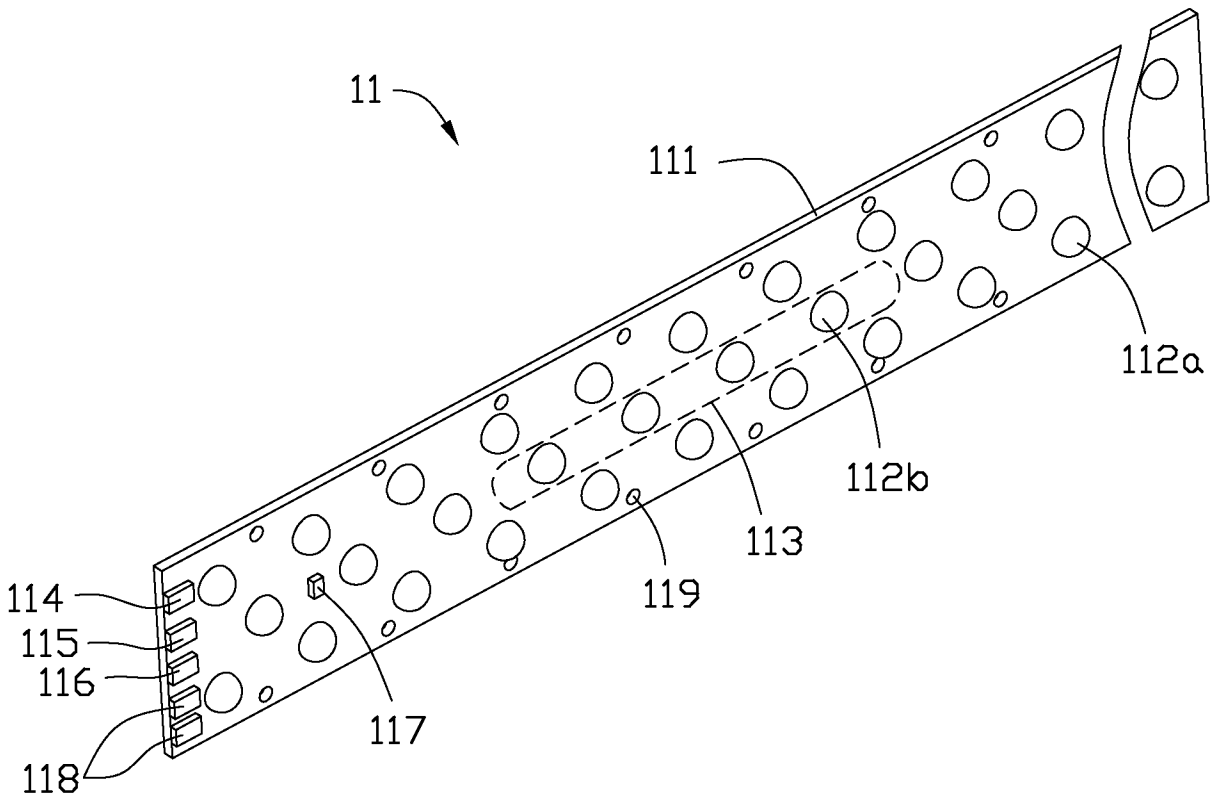
FIG. 3 is an isometric view of an LED module of the LED lamp of FIG. 1.

Referring also to FIG. 3, in this embodiment, the LED module 11 is a light bar. The LED module 11 includes an elongated substrate 111 forming electrical circuits thereon, a plurality of electrodes formed on the substrate 111, a plurality of first LEDs 112*a* (which are located outside a closed broken line 113) and a plurality of second LEDs 112*b* (which are surrounded by the closed broken line 113) surrounded by the first LEDs 112*a*. The first LEDs 112*a* and the second LEDs 112*b* of the LED module 11 are arranged on the substrate 111 and evenly spaced from each other along the substrate 111. The first LEDs 112*a* and the second LEDs 112*b* of the LED module 11 cooperatively function as a main light source 5 (particularly see in FIG. 6) for normal illumination. The second LEDs 112*b* of the LED module 11 cooperatively function as an auxiliary light source 6 (particularly see in FIG. 6) for emergency illumination. The electrodes are located at a left end of the substrate 111, and include a first electrode 114 (which is designated by symbol "a1" in FIG. 6), a second electrode 115 (which is designated by symbol "a2" in FIG. 6), a common electrode 116 (which is designated by symbol "a3" in FIG. 6) and a pair of third electrodes 118. The main light source 5 is electrically connected to the first electrode 114 and the common electrode 116 via the electrical circuits formed on the substrate 111. The auxiliary light source 6 is electrically connected to the second electrode 115 and the common electrode 116 via the electrical circuits formed on the substrate 111. A photoelectric component 117 is arranged on the substrate 111 and electrically connected to the pair of the third electrodes 118 for sensing the brightness of the environment. In this embodiment, the photoelectric component 117 is a photoresistor RL (particularly see in FIG. 6).

A plurality of through holes 119 are defined near two opposite lateral sides of the substrate 111 corresponding to the fixing holes 2112 of the base 211. Fixing devices 13, such as screws, extend through the through holes 119 of the substrate 111 of the LED module 11 and threadedly engage into the fixing holes 2112 of the base 211, thereby to securely and thermally attach the LED module 11 to the bottom surface 2111 of the base 211. A transverse width of the substrate 111 is greater than that of the base 211, whereby two lateral sides of the substrate 111 extend horizontally and outwardly beyond the base 211.

When the LED module 11 is mounted to the bottom surface 2111 of the base 211, a layer of thermal interface material (TIM) may be applied between the substrate 111 and the bottom surface 2111 to eliminate an air interstice therebetween, to thereby enhance heat conduction efficiency between the LED module 11 and the base 211. Alternatively, the substrate 111 of the LED module 11 can be attached to the bottom surface 2111 of the base 211 fixedly and intimately through surface mount technology (SMT). Still alternatively, the substrate 111 can be omitted and the electrical circuits of the substrate 111 are integrally formed on the base 211 of the heat dissipation member 21, whereby an interface between the substrate 111 and the base 211 of the heat dissipation member 21 can be eliminated and a thermal resistance between the LEDs 112*a*, 112*b* and the base 211 is reduced.

The light penetrable tube 12 is a hollow cylinder. The heat dissipation member 21 and the LED module 11 are received in the light penetrable tube 12. Two opposite supporting members 122 are formed on an inner surface of the light penetrable tube 12 and extend along an axial direction of the light penetrable tube 12. The two opposite supporting members 122 are located at a lower portion of the light penetrable tube 12 and spaced from each other. Two lateral sides of the substrate 111 of the LED module 11 are located under the two supporting members 122, respectively. Each lateral side of the substrate 111 is sandwiched between a corresponding supporting member 122 and the inner surface of the light penetrable tube 12. The base 211 of the heat dissipation member 21 is sandwiched between the two supporting members 122, with two lateral sides of the base 211 contacting with the two supporting members 122, respectively. The light penetrable tube 12 defines a plurality of air exchanging holes 123 through the upper portion thereof above the fins 212 of the heat dissipation member 21 to allow air flowing into and out of the light penetrable tube 12.

The electric part 30, which provides drive power, control circuit and power management for the LED module 11, includes a circuit board 31, a rechargeable battery 32 (which is designated by symbol "BT" in FIG. 6), and two end covers 33. The two end covers 33 are arranged at two opposite ends of the light penetrable tube 12. Each end cover 33 is substantially U-shaped in cross section and forms a pair of pins 332 at an outer end surface thereof. The pair of pins 332 is used for engaging with a traditional fluorescent lamp holder to mount the LED lamp 100 thereon. Each end cover 33 forms a projecting ring 331 at a middle portion thereof and a connecting section 333 at an inner side of the projection ring 331. The connecting section 333 of each end cover 33 is inserted into a corresponding end of the light penetrable tube 12. A pair of diametrically opposite projecting beads 3331 is formed on an outer surface of the connecting section 333. The light penetrable tube 12 defines a pair of diametrically opposite engaging holes 121 at each of two opposite ends thereof corresponding to the projecting beads 3331 of each of the two end covers 33, to thereby stably mount the two end covers 33 to the two opposite ends of the light penetrable tube 12.

The circuit board 31 is accommodated in the receiving space 213 of the heat dissipation member 21 and fixed to the base 211 of the heat dissipation member 21. A container 34 made of electrically insulating material is accommodated in the accommodating space 214. The rechargeable battery 32 is received in the container 34.

The circuit board 31 is electrically connected to the electrodes (i.e., the first electrode 114, the second electrode 115, the common electrode 116 and the pair of third electrodes 118) of the LED module 11 via a group of electrical wires 311. Further, the circuit board 31 is electrically connected to the pair of pins 332 of a left end cover 33 via a group of electrical wires 312, whereby an external AC power source can supply electric current to the LEDs 112*a*, 112*b* of the LED module 11 through the pairs of the pins 332 and the circuit board 31 to cause the LEDs 112*a*, 112*b* to emit light. The rechargeable battery 32 is electrically connected to the circuit board 31 via a group of electrical wires 313.

Figure 4:
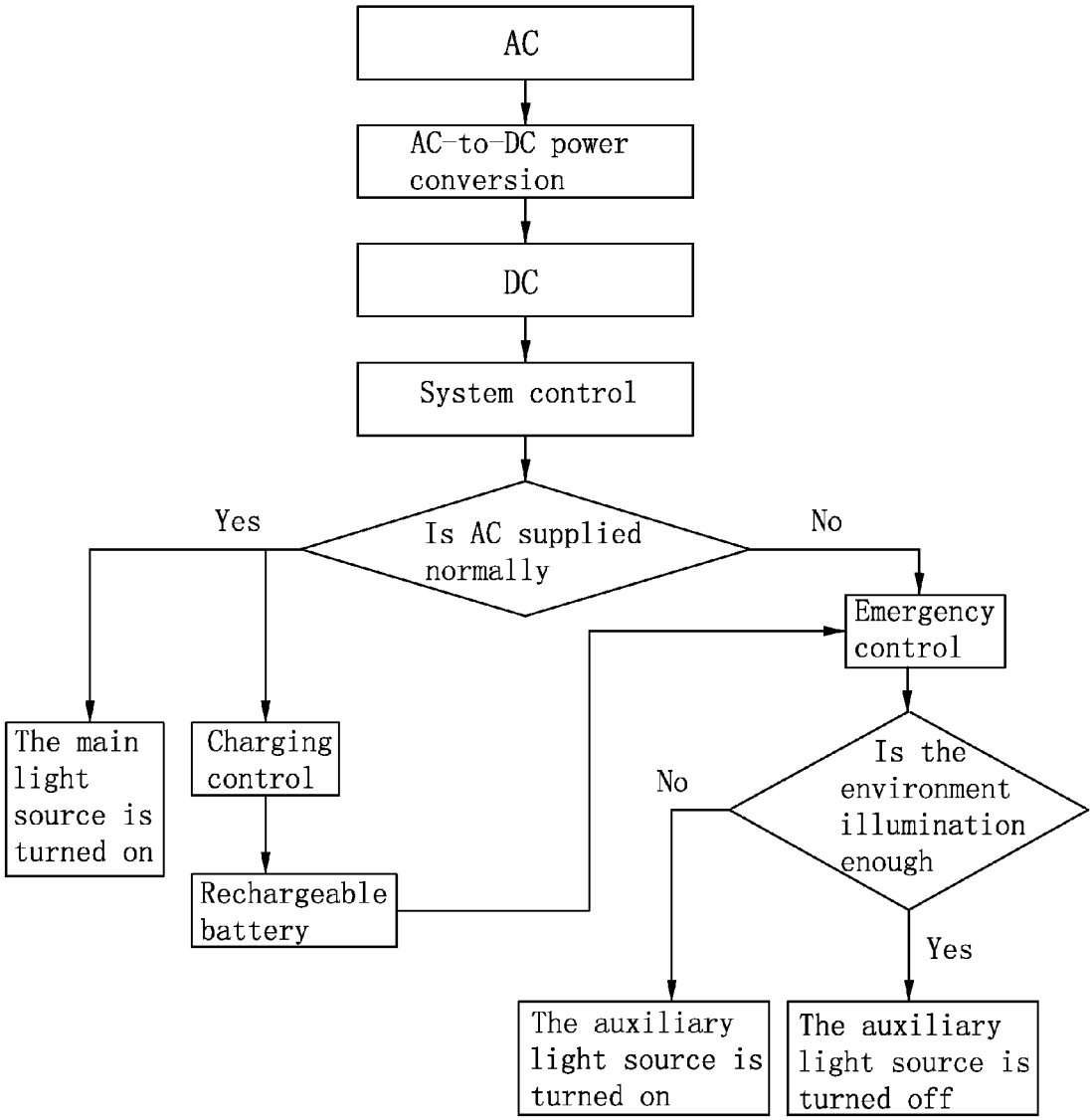
FIG. 4 is a flowchart illustrating an operation of the LED lamp of FIG. 1.

Referring to FIG. 4, in operation, the external AC power source transferred to the circuit board 31 is converted into direct current (DC) power source via AC-to-DC power conversion. Then system control is started. When the external AC power source is supplied normally, the DC power source converted from the external AC power source is supplied to the main light source 5 and the rechargeable battery 32. As a result, the main light source 5 is turned on to emit light for providing normal illumination and the rechargeable battery 32 is charged via charging control.

When the external AC power source supply is interrupted, the main light source 5 is turned off because no DC power source is supplied to the main light source 5. The LED lamp 100 runs in emergency state and is controlled by emergency control. At this time, if the environment illumination is enough, the rechargeable battery 32 will not supply DC current to the auxiliary light source 6. Thus the second LEDs 112*b* of the auxiliary light source 6 are turned off. If the environment illumination is not bright enough, the rechargeable battery 32 will supply DC current to the auxiliary light source 6 to cause the second LEDs 112*b* of the auxiliary light source 6 to lighten for providing emergency illumination. In such a condition, the prolongation of emergency illumination will promote the personal safety during emergency.

Figure 5:
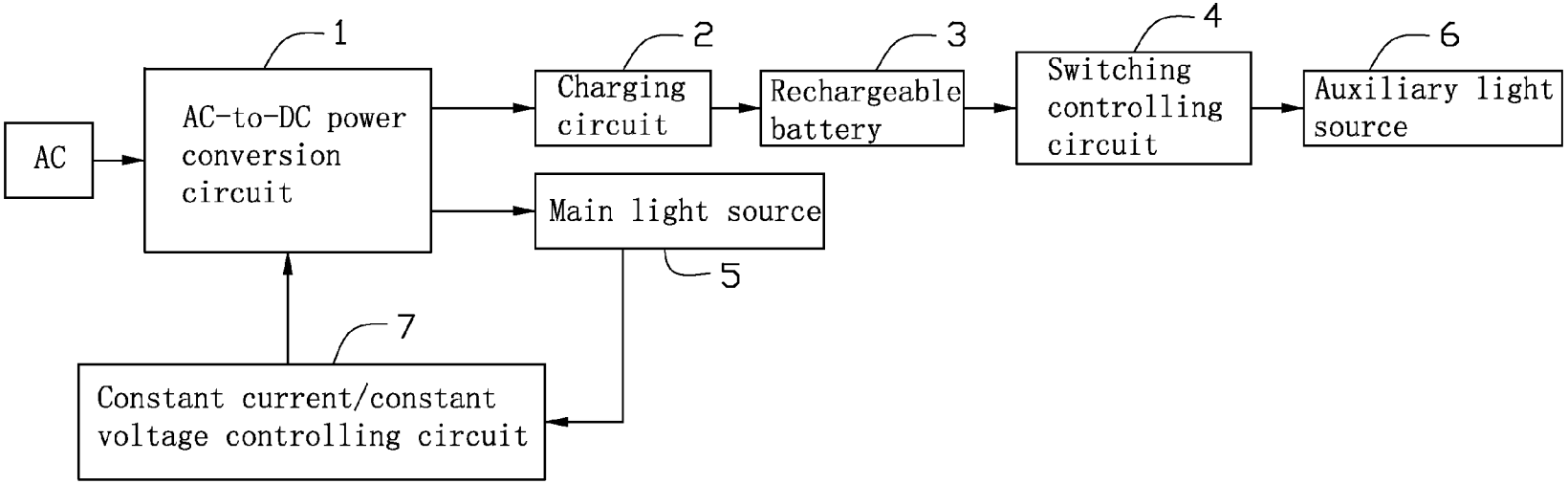
FIG. 5 is a block diagram illustrating a control module of the LED lamp of FIG. 1.
Figure 6:
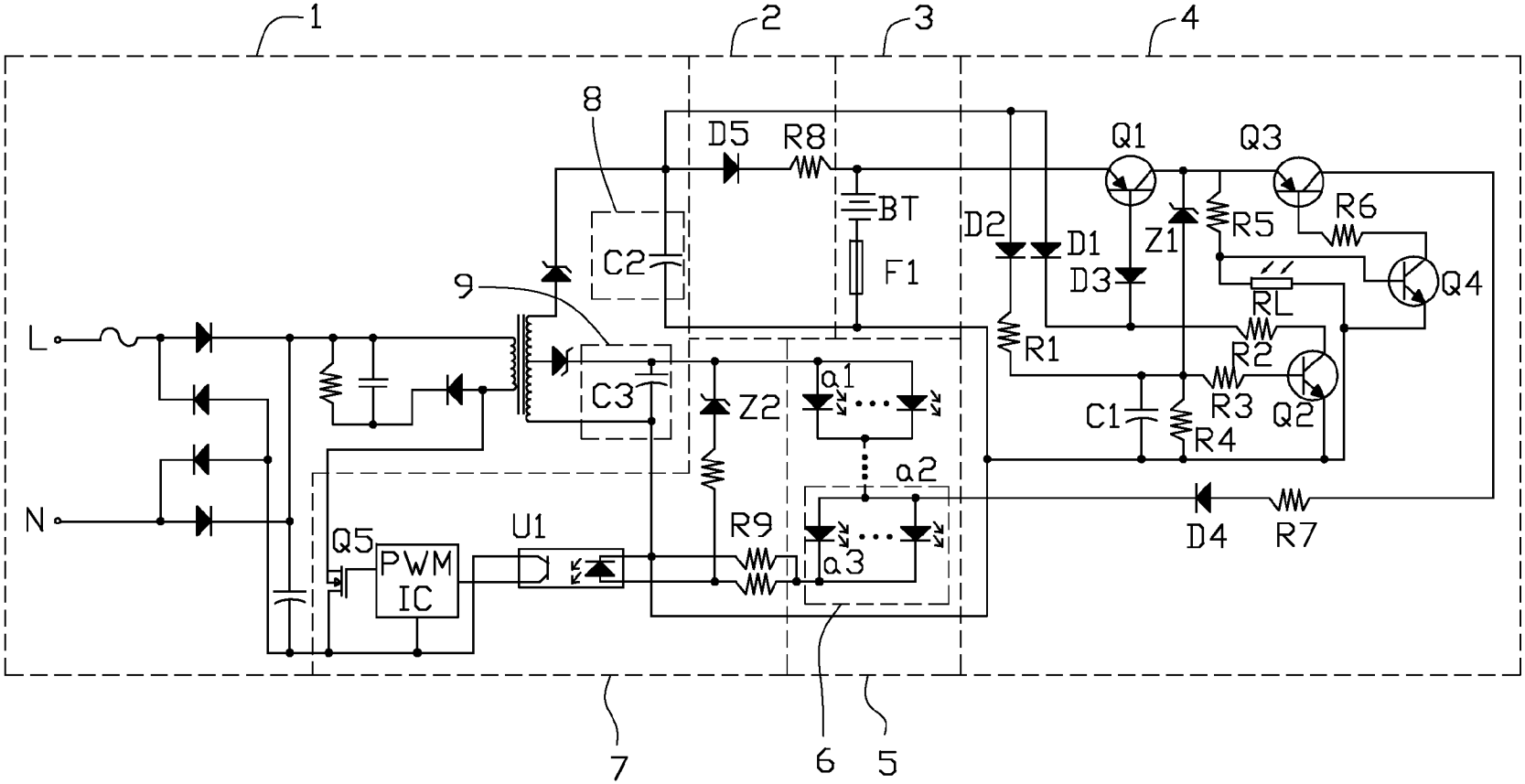
FIG. 6 shows a circuit diagram of the control module in the LED lamp of FIG. 1.

Referring to FIGS. 5 and 6, a control module of the LED lamp 100 includes an AC-to-DC power conversion circuit 1, a charging circuit 2, a rechargeable battery circuit 3, a switching controlling circuit 4, the main light source 5, the auxiliary light source 6, and a constant current/constant voltage controlling circuit 7. The AC-to-DC power conversion circuit 1, the charging circuit 2, the switching controlling circuit 4 and the constant current/constant voltage controlling circuit 7 are integrally formed on the circuit board 31.

An input live terminal L and an input neutral terminal N of the AC-to-DC power conversion circuit 1 are connected to the external AC power source via the left end cover 33. The AC-to-DC power conversion circuit 1 is used for converting the external AC power source into DC power source, and provides a first DC power source 8 at two ends of the capacitor C2 (i.e., a first output end) and a second DC power source 9 at two ends of the capacitor C3 (i.e., a second output end). The first DC power source 8 is used for charging the rechargeable battery BT. The second DC power source 9 is used for providing DC current to the main light source 5 to cause the LEDs 112*a*, 112*b* of the LED module 11 to lighten.

The charging circuit 2 includes a diode D5 and a current limiting resistor R8 which are connected in series. The anode of the diode D5 is connected to the positive terminal of the first DC power source 8, while the cathode of the diode D5 is connected to one end of the current limiting resistor R8. The diode D5 is used for prevent leakage current from the rechargeable battery BT through the current limiting resistor R8 to the capacitor C2. The current limiting resistor R8 is used for limiting the charging current to prevent the rechargeable battery BT from damaging.

The rechargeable battery circuit 3 includes the rechargeable battery BT and a fuse F1. The positive terminal of the rechargeable battery BT is connected to the other end of the current limiting resistor R8, while the negative terminal of the rechargeable battery BT is connected to the negative terminal of the first DC power source 8 through the fuse F1.

The switching controlling circuit 4 includes a capacitor C1, a Zener diode Z1, four diodes D1-D4, seven resistors R1-R7, four transistors Q1-Q4, and the photoresistor RL. The transistors Q1 and Q3 are PNP transistors, while the transistors Q2 and Q4 are NPN transistors.

The anodes of the diodes D1 and D2 are connected to the positive terminal of the first DC power source 8. The cathode of the diode D2 is connected to the negative terminal of the first DC power source 8 successively through two serially connected resistors R1 and R4. The emitter of the transistor Q1 is connected to the positive terminal of the rechargeable battery BT and connected to the cathode of the diode D5 through the current limiting resistor R8. The anode of the diode D3 is connected to the base of the transistor Q1. The cathode of the diode D3 is connected to the cathode of the diode D1. The cathode of the Zener diode Z1 is connected to the collector of the transistor Q1, while the anode of the Zener diode Z1 is connected to a junction point between the serially connected resistors R1 and R4.

The collector of the transistor Q2 is connected to the cathodes of the diodes D1 and D3 through the resistor R2. The emitter of the transistor Q2 is connected to the negative terminal of the first DC power source 8. One end of the resistor R3 is connected to the base of the transistor Q2, while the other end of the resistor R3 is connected to the junction point between the serially connected resistors R1 and R4. The other end of the resistor R3 is further connected to the anode of the capacitor C1. The cathode of the capacitor C1 is connected to the negative terminal of the first DC power source 8.

The emitter of the transistor Q3 is connected to the collector of the transistor Q1 and the cathode of the Zener diode Z1. The collector of the transistor Q3 is connected to the anode of the diode D4 through the resistor R7. One end of the resistor R5 is connected to the emitter of the transistor Q3, while the other end of the resistor R5 is connected to the base of the transistor Q4 and to the negative terminal of the first DC power source 8 through the photoresistor RL. The collector of the transistor Q4 is connected to the base of the transistor Q3 through the resistor R6. The emitter of the transistor Q4 is connected to the negative terminal of the first DC power source 8.

The second electrode a2 of the LED module 11 is connected to the cathode of the diode D4. The first electrode a1 of the LED module 11 is connected to the positive terminal of the second DC power source 9. The common electrode a3 of the LED module 11 is connected to the negative terminal of the second DC power source 9 through a current sense resistor R9. Thus, the main light source 5 is electrically connected to the second DC power source 9 of the AC-to-DC power conversion circuit 1.

The constant current/constant voltage controlling circuit 7 includes the current sense resistor R9, a linear photocoupler U1, and a pulse-width modulation integrated circuit (PWM IC), a Zener diode Z2 and a field effect transistor (FET) Q5. The current sense resistor R9 and the Zener diode Z2 are respectively used for providing an electric current feedback signal and a voltage feedback signal to the PWM IC via the linear photocoupler U1, to thereby rectify the waveform of the field effect transistor Q5 for stabilizing the output voltage and electric current of the first DC power source 8 and the second DC power source 9.

The negative terminal of the rechargeable battery BT is connected to the common electrode a3 successively through the fuse F1 and the current sense resistor R9. Thus, the auxiliary light source 6 is electrically connected to the rechargeable battery BT through the switching controlling circuit 4.

When the external AC power source is supplied normally, the AC-to-DC power conversion circuit 1 converts the AC power input into DC power, and provides the DC power to the first DC power source 8 for charging the rechargeable battery BT and to the second DC power source 9 for driving the main light source 5 (i.e., the first LEDs 112*a* and the second LEDs 112*b* of the LED module 11) to lighten. The base of the transistor Q1 is connected to the positive terminal of the first DC power source 8 through the diode D3 and the diode D1. A high potential is maintained at the base of the transistor Q1. Thus, the transistor Q1 is turned off. Therefore, the rechargeable battery BT can not supply DC current to the auxiliary light source 6 (i.e., the second LEDs 112*b*) through the transistor Q1. The first DC power source 8 is divided through the resistors R1 and R4, and then charges the capacitor C1.

When the external AC power source is interrupted, the first DC power source 8 and the second DC power source 9 stop the output of the DC power therefrom. Therefore, the main light source 5 (i.e., the first LEDs 112*a* and the second LEDs 112*b* of the LED module 11) is turned off and the charging circuit 2 stops charging the rechargeable battery BT. The capacitor C1 discharges through the resistor R3. A high potential is maintained at the base of the transistor Q2. Thus, the transistor Q2 is turned on. When the transistor Q2 is turned on, a low potential is maintained at the base of the transistor Q1. Thus, the transistor Q1 is turned on. Therefore, the switching controlling circuit 4 is switched to an emergency illumination mode.

At this time, whether the auxiliary light source 6 is turned on is determined by the photoresistor RL. In other words, the photoresistor RL functions as a switch between the rechargeable battery BT and the auxiliary light source 6 when the external AC power source is interrupted.

If the environment illumination is not bright enough, the photoresistor RL has a relatively high resistance under a relatively low illumination level. A high potential is maintained at the base of the transistor Q4. Thus, the transistor Q4 is turned on. When the transistor Q4 is turned on, a low potential is maintained at the base of the transistor Q3. Thus, the transistor Q3 is turned on. Therefore, the rechargeable battery BT can supply DC current to the auxiliary light source 6 through the transistor Q3. The second LEDs 112*b* of the auxiliary light source 6 (i.e., the LEDs between the second electrode a2 and the common electrode a3) are turned on to emit light for providing emergency illumination. Simultaneously, the rechargeable battery BT continuously charges the capacitor C1 through the Zener diode Z1 to maintain the transistor Q2 to be turned on. Therefore, the rechargeable battery BT can continuously supply DC current to the auxiliary light source 6.

If the environment illumination is bright enough, the photoresistor RL has a relatively low resistance under a relatively high illumination level. A low potential is maintained at the base of the transistor Q4. Thus, the transistor Q4 is turned off. When the transistor Q4 is turned off, a high potential is maintained at the base of the transistor Q3. Thus, the transistor Q3 is turned off. Therefore, the rechargeable battery BT can not supply DC current to the auxiliary light source 6 through the transistor Q3. The auxiliary LED light source 22 does not provide emergency illumination, to thereby save power of the rechargeable battery BT for prolonging the emergency illumination time.

It is to be understood, however, that even though numerous characteristics and advantages of the present invention have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp, comprising:

an optical part comprising a hollow light penetrable tube and an LED module received in the light penetrable tube, the LED module being provided with at least one first LED and at least one second LED, the at least one first LED and the at least one second LED of the LED module cooperatively functioning as a main light source for normal illumination, the at least one second LED of the LED module functioning independently as an auxiliary light, source for emergency illumination;

a heat dissipation member received in the light penetrable tube, the LED module being thermally attached to the heat dissipation member; and an electric part comprising a circuit board, a rechargeable battery and two end covers, the circuit board and the rechargeable battery being arranged in the light penetrable tube, the two end covers being arranged at two opposite ends of the light penetrable tube, the circuit board forming an AC-to-DC power conversion circuit, a charging circuit and a switching controlling circuit thereon, wherein when an external AC power source is transferred to the AC-to-DC power conversion circuit, the AC-to-DC power conversion circuit converts the AC power source to DC power source and provides a first DC power source at a first output end thereof and a second DC power source at a second output end thereof, the charging circuit being electrically connected to the first output end of the AC-to-DC power conversion circuit to receive the first DC power source, the rechargeable battery being electrically connected to the charging circuit, the auxiliary light source being electrically connected to the rechargeable battery through the switching controlling circuit, the main light source being electrically connected to the second output end of the AC-to-DC power conversion circuit to receive the second DC power source and adapted for providing normal illumination when the external AC power source is supplied normally, the auxiliary light source being adapted for providing emergency illumination when the external AC power source is interrupted, wherein when the external AC power source is supplied normally the switching controlling circuit electrically disconnects the rechargeable battery and the auxiliary light source and wherein when the external AC power source is interrupted the switching controlling circuit electrically interconnects the rechargeable battery and the auxiliary light source;

wherein a constant current/constant voltage controlling circuit is integrally formed on the circuit board, the constant current/constant voltage controlling circuit being electrically connected between the AC-to-DC power conversion circuit and the main light source, the constant current/constant voltage controlling circuit outputting a feedback signal to the AC-to-DC power conversion circuit for rectifying the output voltage and electric current of the first DC power source and the second DC power source, and wherein the constant current/constant voltage controlling circuit comprises a current sense resistor, a linear photocoupler, a pulse-width modulation integrated circuit (PWM IC), a Zener diode and a field effect transistor, the current sense resistor and the Zener diode being respectively used for providing an electric current feedback signal and a voltage feedback signal to the PWM IC via the linear photocoupler, to thereby rectify the waveform of the field effect transistor for stabilizing the output voltage and electric current of the first DC power source and the second DC power source.

* * * * *